US005575045A

United States Patent [19]

Chu

[11] Patent Number: 5,575,045

[45] Date of Patent: Nov. 19, 1996

[54] ROLLER SKATE FASTENING DEVICE

[76] Inventor: Hsien-Kuang Chu, 58, Ma Yuan West St., Taichung, Taiwan

[21] Appl. No.: 581,983

[22] Filed: Jan. 2, 1996

[51] Int. Cl.[6] ..... A43C 11/00

[52] U.S. Cl. ..... 24/68 SK; 24/70 SK; 24/71 SK; 36/50.1

[58] Field of Search ..... 24/68 SK, 69 SK, 24/70 SK, 71 SK, 68 A, 68 CD; 36/50.1

[56] References Cited

U.S. PATENT DOCUMENTS 4,051,611 10/1977 Chalmers ..... 36/50.1

4,546,521 10/1985 Ribarits ..... 24/70 SK

*Primary Examiner*—Victor N. Sakran

[57] ABSTRACT

A roller skate fastening device has a positioning seat to receive a pressing fastener. The seat has a positioning hole and two lugs. The lugs extend upward from two sides of the seat. Each lug has a hook recess. The pressing fastener has a pressed portion, a groove and a jag. Two through holes are formed on the walls abutting the groove. A spring recess is formed on the pressing fastener. A spring has the first and the second legs. The spring and the first leg are embedded in the spring recess. The second leg hooks the hook recess. The groove receives a movable fastener which has a protruded fang, a round recess, and a trip bar. A pin passes through the holes of the lugs, the through holes, and the round recess.

1 Claim, 5 Drawing Sheets

ROLLER SKATE FASTENING DEVICE

BACKGROUND OF THE INVENTION

The invention relates to roller skate fasteners. More particularly, the invention relates to a roller skate fastening device which has less elements than the conventional roller skate fasteners.

Referring to FIGS. 1, 2, 2A and 3, a roller skate 10 comprises three crenated straps 11 with a large number of crenatures 111 thereon. The crenature 111 has the first inclined surface 112 and the second inclined surface 113. The slope of the second inclined surface 113 is steeper than that of the first inclined surface 112. The roller skate fastener 12 has a positioning seat 20 with an upper surface 24 to receive a movable fastener 30, a slot 32 formed on the movable fastener 30 to receive a U-shaped retaining plate 40, and a pressing fastener 50 disposed on the retaining plate 40. The positioning seat 20 has an upper surface 24 with a positioning hole 21 thereon, two lugs 23 with the corresponding holes 25 to receive the pins 26. A rivet 22 passes through the positioning hole 21 to fasten the positioning seat 20 on the roller skate 10. The movable fastener 30 has a slot 32 defined by a pressed bar 31 and two legs 33, and a circular hole 34 and a rectangular hole 35 formed on each leg 33. The slot 32 receives the retaining plate 40. The retaining plate 40 has two fins 41. Each fin 41 has a round hole 42 and a hook hole 43 thereon. The pressing fastener 50 has an upper pressed portion 54, a tip 55 extending downward from one end of the fastener 50, a spring recess 51 adjacent to a through hole 52, and a block disposed at one side of the fastener 50 to block a leg 441 of a torsion spring 44. The pin 36 passes through the holes 35, 43 and 52. The leg 442 hooks the hook hole 43. The tip 55 engages with the crenature 111. The user has to hold the roller skate 10 with one hand and fasten the fastener 12 with the other hand. The user has to apply a strong force to pull the strap 11 in order to fasten the fastener 12 tightly. Further, the fastener 12 has too many elements so that the manufacture and assembly of the fastener 12 are difficult and cumbersome.

SUMMARY OF THE INVENTION

An object of the invention is to provide a roller skate fastening device to facilitate the fastening of the roller skate.

Accordingly, a roller skate fastening device has a positioning seat to receive a pressing fastener thereon. The positioning seat has a positioning hole thereon and two lugs with the corresponding holes to receive the pins. The positioning lugs extend upward from two sides of the positioning seat. Each lug has a hook recess disposed on the periphery of the lug. A rivet passes through the positioning hole to fasten the positioning seat on the roller skate. The pressing fastener has a pressed portion, a groove and a protruded jag extending downward from one end of the pressing fastener. Two through holes are formed on the walls abutting the groove. A spring recess is formed on the pressing fastener adjacent to one of the through hole. A torsion spring has the first leg and the second leg. The spring is embedded in the spring recess. The first leg is embedded in the spring recess also. The second leg hooks the hook recess. The groove receives a movable fastener. The movable fastener has a protruded fang disposed at one end of the movable fastener, a round recess formed adjacent to the protruded fang, and a trip bar disposed at the other end of the movable fastener. A pin passes through the holes of the lugs, the through holes of the pressing fastener, and the round recess of the movable fastener.

BRIEF DESCRIPTION OF THE DRAWINGS

FIGS. 2A and 3 are sectional views illustrating the operation of a roller skate fastener of the prior art;

DETAILED DESCRIPTION OF THE INVENTION

Figure 1:
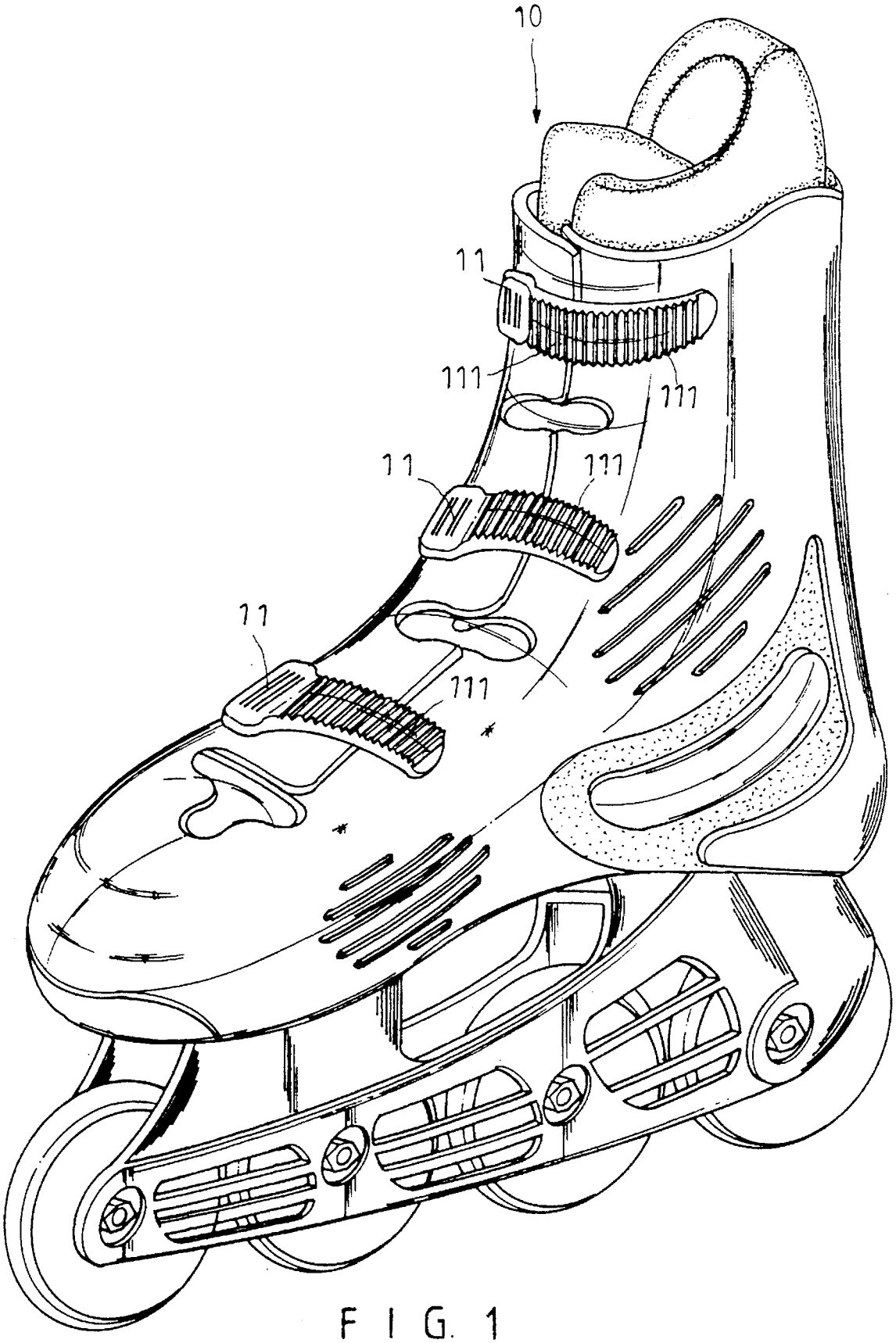
FIGS. 1 and 4 are perspective views of a roller skate.
Figure 2:
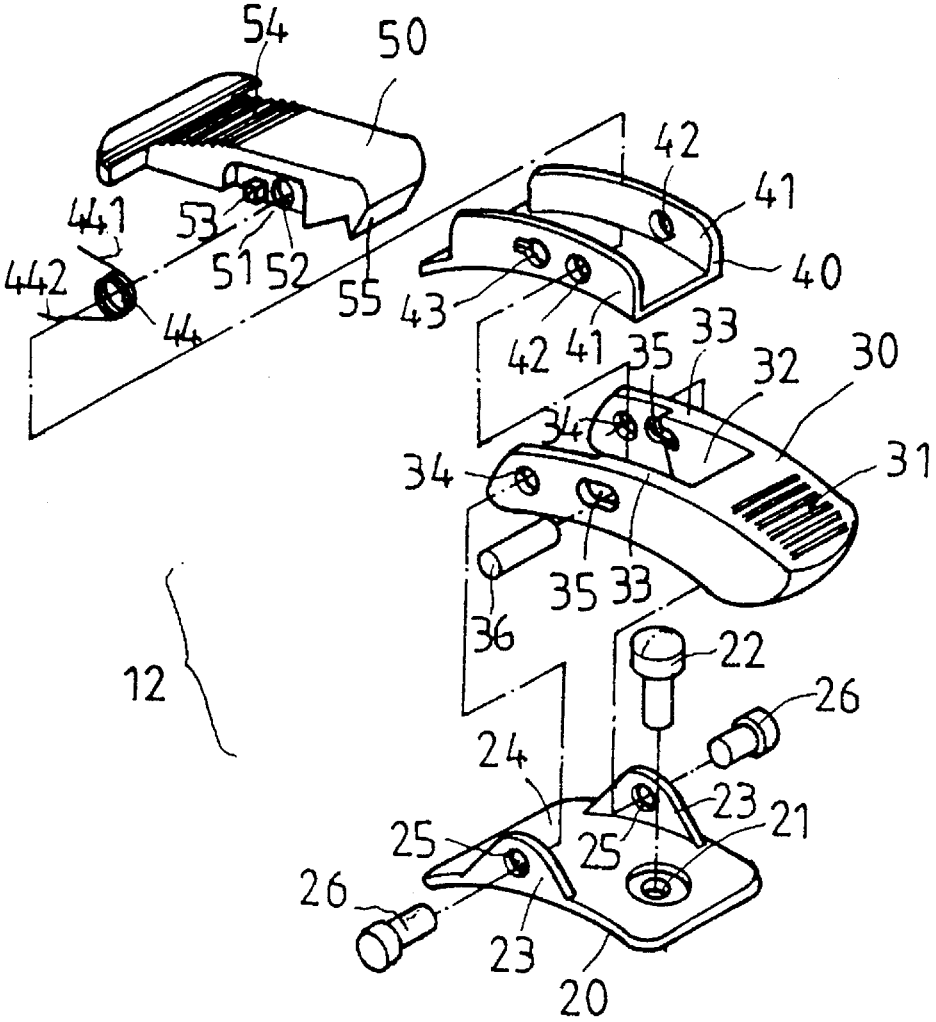
FIG. 2A perspective exploded view of a roller skate fastener of the prior art.
Figure 2A:
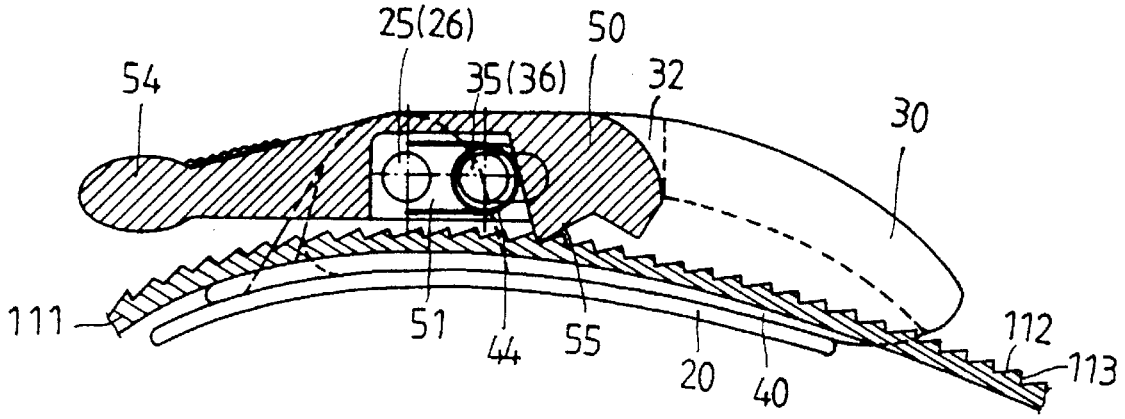
Figure 3:
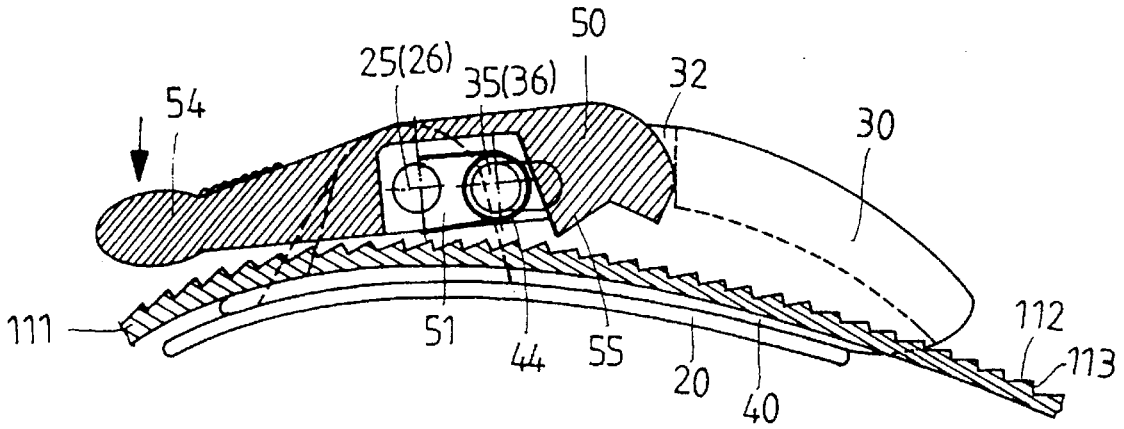
Figure 5:
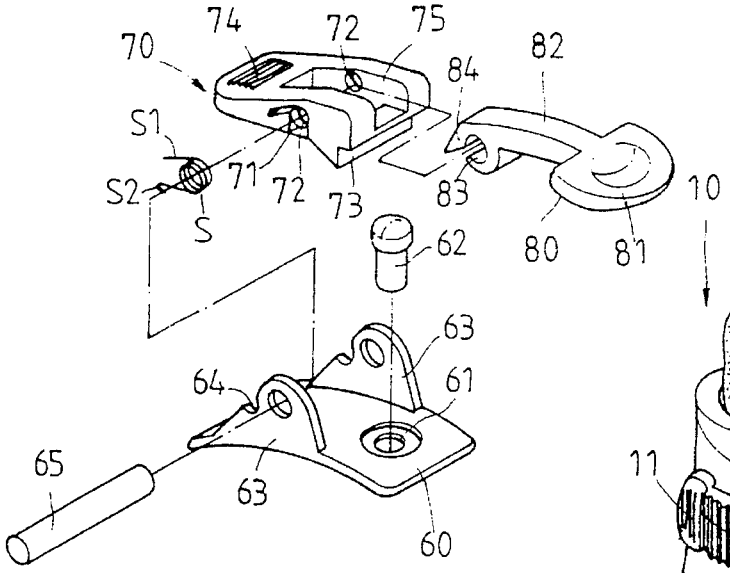
FIG. 5 is a perspective exploded view of a roller skate fastening device of a preferred embodiment in accordance with the invention.
Figure 4:
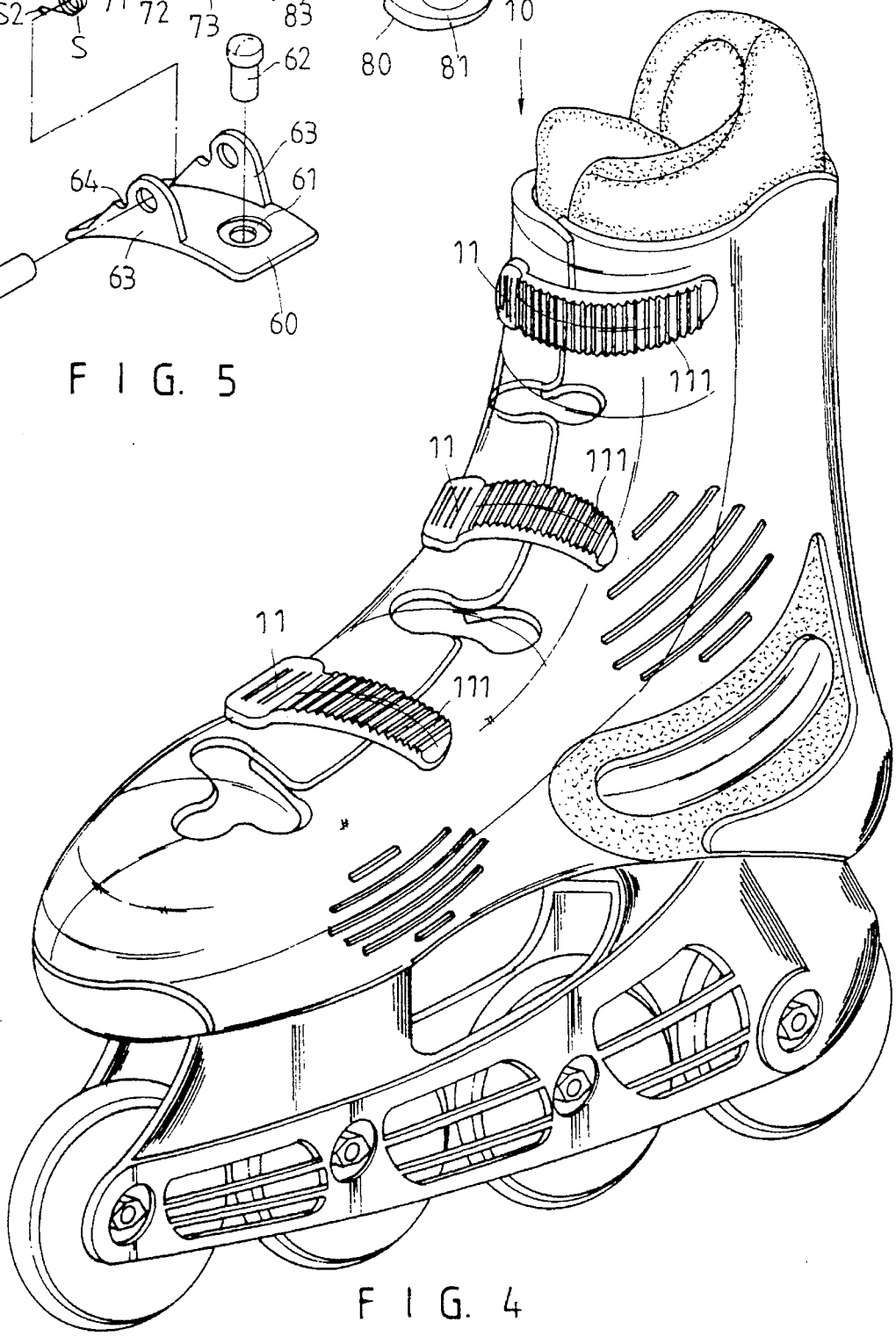
Figure 5A:
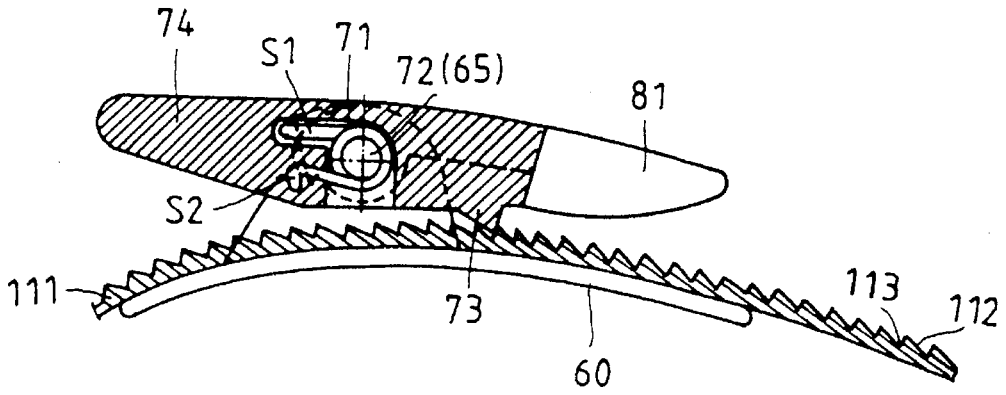
FIGS. 5A, 6 and 7 are sectional views illustrating the operation of a roller skate fastening device.
Figure 6:
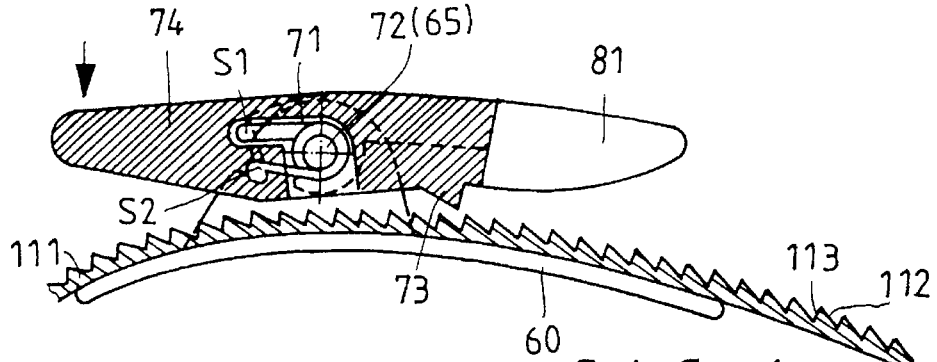
Figure 7:
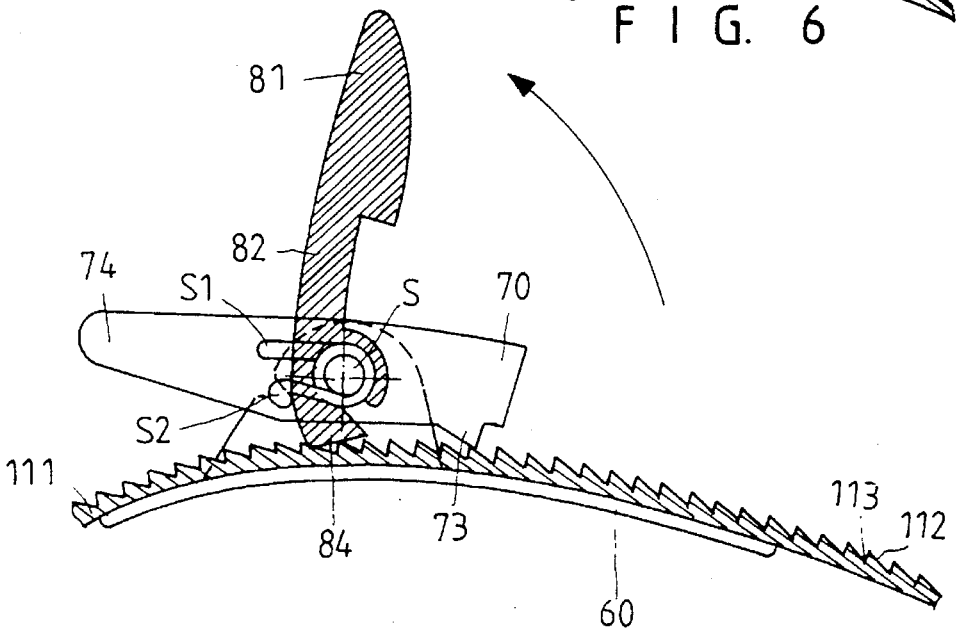

Referring to FIGS. 4, 5 and 5A, a roller skate 10 comprises three crenated straps 11 with a large number of crenatures 111 thereon. The crenature 111 has the first inclined surface 112 and the second inclined surface 113. The slope of the second inclined surface 113 is steeper than that of the first inclined surface 112. The roller skate fastening device comprises a positioning seat 60 to receive a pressing fastener 70 thereon. The positioning seat 60 has a positioning hole 61 thereon and two lugs 63 with the corresponding holes to receive the pins 65. The positioning lugs 63 extend upward from two sides of the positioning seat 60. Each lug 63 has a hook recess 64 disposed on the periphery of the lug 63. A rivet 62 passes through the positioning hole 61 to fasten the positioning seat 60 on the roller skate 10. The pressing fastener 70 has a pressed portion 74, a groove 75 and a protruded jag 73 extending downward from one end of the pressing fastener 70. Two through holes 72 are formed on the walls abutting the groove 75. A spring recess 71 is formed on the pressing fastener 70 adjacent to one of the through hole 52. A torsion spring S has the first leg S1 and the second leg S2. The spring S is embedded in the spring recess 71. The first leg S1 is embedded in the spring recess 71 also. The second leg S2 hooks the hook recess 64. The groove 75 receives a movable fastener 80. The movable fastener 80 has a protruded fang 84 disposed at one end of the movable fastener 80, a round recess 83 formed adjacent to the protruded fang 84, and a trip bar 81 disposed at the other end of the movable fastener 80. A pin 65 passes through the holes of the lugs 63, the through holes 72 of the pressing fastener 70, and the round recess 83 of the movable fastener 80. The protruded jag 73 engages with the corresponding crenature 111.

Referring to FIGS. 5, 5A, 6 and 7, the protruded jag 73 is always engaged with the corresponding crenature 111. The trip bar 81 can be pulled upward so that the protruded fang 84 can move along the crenated strap 11. When the fang 84 reaches the predetermined crenature 111, the trip bar 81 can be pressed down. When the pressed portion 74 is pressed down, the jag 73 will be disengaged with the corresponding crenature 111. Thus the roller skate fastening device and the strap 11 are unfastened. When the pressed portion 74 is pulled upward, the jag 73 will be engaged with the corresponding crenature 111 again.

The invention is not limited to the above embodiment but various modification thereof may be made. It will be understood by those skilled in the art that various changes in form and detail may be made without departing from the scope of the invention.

I claim:

1. A roller skate fastening device comprising:

a positioning seat to receive a pressing fastener thereon;

said positioning seat having a positioning hole thereon and two lugs with corresponding holes to receive corresponding pins;

said lugs extending upward from two sides of said positioning seat;

each of said lug having a hook recess disposed on a periphery of said lug;

a rivet passing through said positioning hole to fasten said positioning seat on a roller skate;

said pressing fastener having a pressed portion at a first end of said pressing fastener, a groove and a protruded jag extending downward from a second end of said pressing fastener;

two through holes formed on walls abutting said groove;

a spring recess formed on said pressing fastener adjacent to one of said through hole;

a torsion spring having a first leg and a second leg;

said spring embedded in said spring recess, said first leg embedded in said spring recess also, and said second leg hooking said hook recess;

said groove receiving a movable fastener;

said movable fastener having a protruded fang disposed at a first end of said movable fastener, a round recess formed adjacent to said protruded fang, and a trip bar disposed at a second end of said movable fastener; and a pin passing through said holes of said lugs, said through holes of said pressing fastener, and said round recess of said movable fastener.

* * * * *